US009002253B2

(12) United States Patent
Son et al.

(10) Patent No.: US 9,002,253 B2
(45) Date of Patent: Apr. 7, 2015

(54) HEATING MEMBER AND FUSING DEVICE INCLUDING THE SAME

(71) Applicant: Samsung Electronics Co., Ltd., Suwon-Si, Gyeonggi-Do (KR)

(72) Inventors: Yoon-chul Son, Hwaseong-si (KR); Dong-earn Kim, Seoul (KR); Dong-ouk Kim, Pyeongtaek-si (KR); Ha-jin Kim, Suwon-si (KR); Sung-hoon Park, Seoul (KR); Min-jong Bae, Yongin-si (KR); Sang-eui Lee, Yongin-si (KR); Kun-mo Chu, Seoul (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 13 days.

(21) Appl. No.: 13/904,233

(22) Filed: May 29, 2013

(65) Prior Publication Data

US 2014/0126940 A1 May 8, 2014

(30) Foreign Application Priority Data

Nov. 6, 2012 (KR) ..... 10-2012-0125082

(51) Int. Cl.

| | |
|---|---|
| ***G03G 15/20*** | (2006.01) |
| ***H05B 3/03*** | (2006.01) |
| ***H05B 3/14*** | (2006.01) |
| ***H05B 3/46*** | (2006.01) |

(52) U.S. Cl.

CPC ..... *H05B 3/03* (2013.01); *H05B 3/145* (2013.01); *H05B 3/46* (2013.01); *G03G 15/2042* (2013.01); *G03G 15/2057* (2013.01); *H05B 2214/04* (2013.01); *G03G 2215/2035* (2013.01)

(58) Field of Classification Search

USPC ..... 399/333

See application file for complete search history.

(56) References Cited

U.S. PATENT DOCUMENTS

| | | | |
|---|---|---|---|
| 2011/0222932 | A1 | 9/2011 | Hayase et al. |
| 2011/0293340 | A1 | 12/2011 | Yamamoto et al. |

FOREIGN PATENT DOCUMENTS

| | | | |
|---|---|---|---|
| JP | 06-266242 | A | 9/1994 |
| KR | 1020010085213 | A | 9/2001 |

*Primary Examiner* — David Bolduc
*Assistant Examiner* — Barnabas Fekete
(74) *Attorney, Agent, or Firm* — Harness, Dickey & Pierce, P.L.C.

(57) ABSTRACT

A heating member includes: a resistive heating layer including: a medium-passing area, and non-medium-passing areas respectively on opposing sides of the medium-passing area at opposing side portions of the resistive heating layer; a core which supports the resistive heating layer; a thermally conductive layer between the resistive heating layer and the core, and disposed in a non-medium passing area at a side portion of the resistive heating layer; and an electrode which is between the resistive heating layer and the core, contacts the side portion of the resistive heating layer and supplies current to the resistive heating layer. A ratio of a contact area between the thermally conductive layer and the resistive heating layer to an area of the non-medium-passing area in which the thermally conductive layer is disposed, ranges from about 5% to about 25%.

20 Claims, 11 Drawing Sheets

HEATING MEMBER AND FUSING DEVICE INCLUDING THE SAME

CROSS-REFERENCE TO RELATED APPLICATIONS

This application claims priority to Korean Patent Application No. 10-2012-0125082, filed on Nov. 6, 2012, and all the benefits accruing therefrom under 35 U.S.C. §119, the disclosure of which is incorporated herein in its entirety by reference.

BACKGROUND

1. Field

Provided are heating members using resistive heaters, and fusing devices including the heating members.

2. Description of the Related Art

Electrophotographic image forming apparatuses supply toner to an electrostatic latent image formed on an image receiving body to form a visible toner image on the image receiving body, transfer the toner image onto a printing medium, and fuse the transferred toner image onto the printing medium. The toner is fabricated by adding various functional additives to a base resin. The fusing process includes heating and compressing the toner.

SUMMARY

Provided are heating members that may reduce or effectively prevent non-medium-passing areas from being overheated and a fusing device including the heating members.

Additional aspects will be set forth in part in the description which follows and, in part, will be apparent from the description, or may be learned by practice of the presented embodiments.

According to an aspect of the present invention, a heating member includes: a resistive heating layer including: a medium-passing area, and non-medium-passing areas respectively on opposing sides of the medium-passing area at opposing side portions of the resistive heating layer; a core which supports the resistive heating layer; a thermally conductive layer between the resistive heating layer and the core, and disposed in a non-medium passing area at a side portion of the resistive heating layer; and an electrode which is between the resistive heating layer and the core, contacts the side portion of the resistive heating layer and supplies current to the resistive heating layer. A ratio of a contact area between the thermally conductive layer and the resistive heating layer to an area of the non-medium-passing area in which the thermally conductive layer is disposed, ranges from about 5% to about 25%.

The ratio of the contact area between the thermally conductive layer and the resistive heating layer to the area of the non-medium-passing area in which the thermally conductive layer is disposed may range from about 12% to about 20%.

The electrode and the thermally conductive layer may be connected to each other.

The electrode and the thermally conductive layer may be separated from each other.

The electrode and the thermally conductive layer may include the same material.

The electrode and the thermally conductive layer may be electroless plated. The electrode and the thermally conductive layer may have a columnar structure. The electrode and the thermally conductive layer may include a material selected from the group consisting of nickel (Ni), copper (Cu), palladium (Pd), silver (Ag), and gold (Au), and a combination thereof. The electrode and the thermally conductive layer may include one of phosphorus (P) and boron (B).

According to another aspect of the present invention, a heating member includes: a resistive heating layer including: a medium-passing area, non-medium-passing areas respectively on opposing sides of the medium-passing area at opposing side portions of the resistive heating layer, and electrode contact areas respectively at the opposing side portions of the resistive heating layer, and opposing the medium-passing area with respect to the non-medium-passing areas; a core which supports the resistive heating layer; and an electrode which is between the core and the resistive heating layer, supplies current to the resistive heating layer, and respectively contacts a side portion of the resistive heating layer. The electrode includes: a contact portion which contacts an electrode contact area of the resistive heating layer, and a thermally conductive portion which extends from the contact portion, and contacts a non-medium-passing area of the resistive heating layer.

A ratio of a contact area between the thermally conductive portion and the resistive heating layer to an area of the non-medium-passing area of the resistive heating layer, may range from about 5% to about 25%. The ratio of the contact area between the thermally conductive portion and the resistive heating layer to the area of the non-medium-passing area of the resistive heating layer, may range from about 12% to about 20%.

The electrode may be electroless plated. The electrode may have a columnar structure.

According to another aspect of the present invention, a fusing device includes: the heating member; and a nip-forming unit which faces the heating member and forms a fusing nip in cooperation with the heating member.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
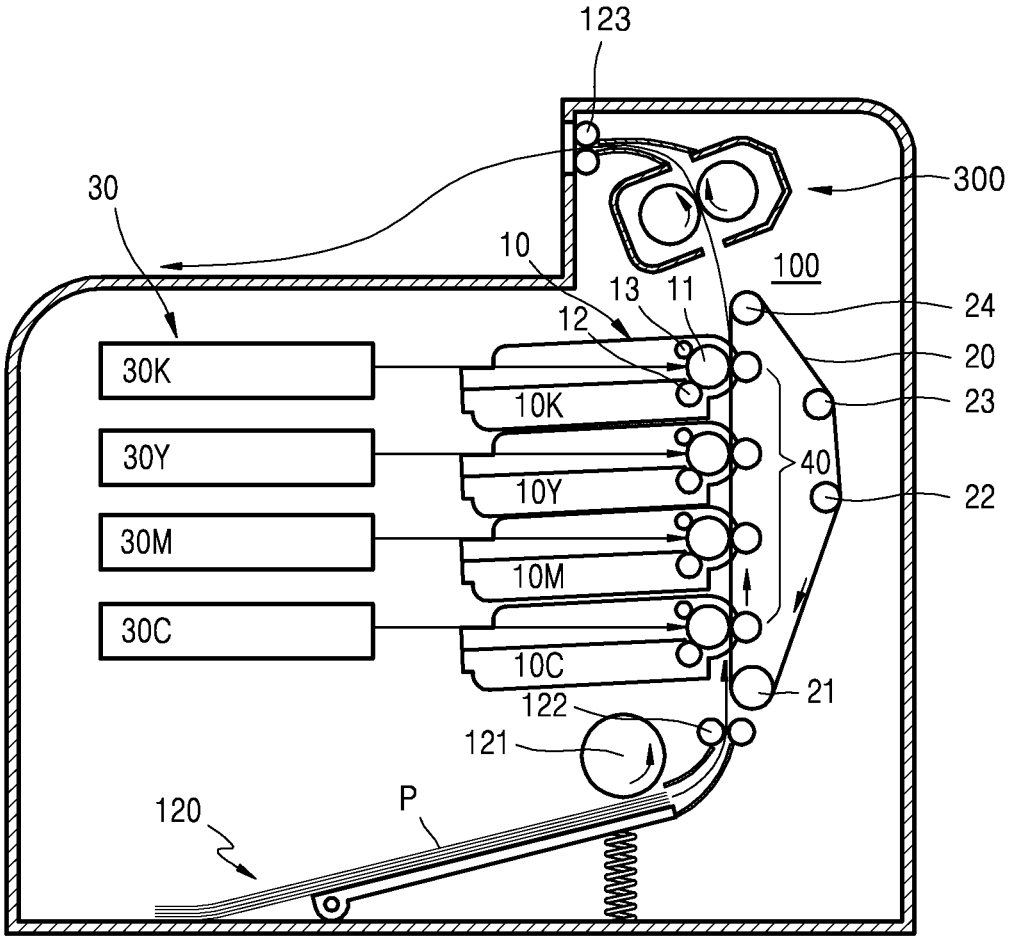
FIG. 1 is a side cross-sectional view illustrating an electrophotographic image forming apparatus including a heating member and a fusing device, according to an embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, the element or layer can be directly on, connected or coupled to another element or layer or intervening elements or layers. In contrast, when an element is referred to as being "directly on," "directly connected to" or "directly coupled to" another element or layer, there are no intervening elements or layers present. As used herein, connected may refer to elements being physically and/or electrically connected to each other. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath," "below," "lower," "under," "above," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" relative to other elements or features would then be oriented "above" relative to the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the term "and/or" includes any and all combinations of one or more of the associated listed items. Expressions such as "at least one of," when preceding a list of elements, modify the entire list of elements and do not modify the individual elements of the list. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

A fusing device includes a heat roller and a pressure roller that are engaged with each other to form a fusing nip. Electrodes for supplying current to a heat source such as a halogen lamp or a planar heating body are disposed on both ends of the heat roller using the heat source. Heat generated in the heat source during the fusing process is transmitted to a recording medium. In general, a length of the heat roller is greater than a width of paper upon which an image is to be printed. Hence, the heat roller has a non-sheet-passing area through which the paper does not pass. Since heat is not consumed by the paper in the non-sheet-passing area, the non-sheet-passing area of the heat roller may overheat to a high temperature. Accordingly, physical properties of a material of a heating layer or a release layer of the heat roller may be degraded. Also, since overheat is transmitted to the electrodes, physical properties of the electrodes may also be degraded and cracks therein may occur.

In order to reduce or effectively prevent the non-sheet-passing area from being overheated, attempts have been made to remove heat generated in the heat roller by making a thermally conductive roller contact the heat roller. However, according to these attempts, since the thermally conductive roller removes not only heat of the non-sheet-passing area but also heat of a sheet-passing area through which the paper passes, an average temperature of the heat roller is reduced, thereby degrading fusing quality of the heat roller. Also, since an additional component is used, costs for manufacturing an image forming apparatus are increased.

The present invention will now be described more fully with reference to the accompanying drawings, in which embodiments of the invention are shown.

FIG. 1 is a side cross-sectional view illustrating an electrophotographic image forming apparatus including a heating member 310 and a fusing device 300, according to an embodiment of the present invention.

Referring to FIG. 1, a printing unit 100 that prints an image on a recording medium P by using an electrophotographic process and the fusing device 300 are illustrated. The image forming apparatus of FIG. 1 is a dry electrophotographic image forming apparatus that prints a color image by using a dry developing agent (hereinafter, referred to as toner).

The printing unit 100 may include an exposure unit 30, a developer 10 and a transfer unit. The printing unit 100 may include four developers 10 receiving color toner, cyan (C), magenta (M), yellow (Y) and black (K) (hereinafter, referred to as developers 10C, 10M, 10Y and 10K) and four exposure units 30 (hereinafter, referred to as exposure units 30C, 30M, 30Y and 30K) respectively corresponding to the developers 10C, 10M, 10Y and 10K, in order to print a color image.

Each of the developers 10C, 10M, 10Y and 10K may include a photosensitive drum 11 on which an electrostatic latent image is formed, and a developing roller 12 that develops the electrostatic latent image. A charging bias is applied to a charging roller 13 in order to charge an outer circumferential surface of the photosensitive drum 11 with a uniform electric potential. A corona discharger (not shown) instead of the charging roller 13 may be used. The developing roller 12 supplies toner to the photosensitive drum 11 by attaching the toner to an outer circumferential surface of the developing roller 12. A developing bias for supplying toner to the photosensitive drum 11 is applied to the developing roller 12. Although not shown in FIG. 1, each of the developers 10C, 10M, 10Y and 10K may further include a supply roller that attaches toner received therein to the developing roller 12, a regulating unit that regulates the amount of toner attached to the developing roller 12 and/or an agitator that conveys toner received therein toward the supply roller and/or the developing roller 12. Also, although not shown in FIG. 1, each of the developers 10*c*, 10M, 10Y and 10K may further include a cleaning blade for removing toner remaining on the outer circumferential surface of the photosensitive drum 11 and/or a receiving space for receiving the removed toner.

The transfer unit may include a recording medium conveying belt 20 and four transfer rollers 40. The recording medium conveying belt 20 faces the outer circumferential surfaces of the photosensitive drums 11 that are exposed to the outside of the developers 10*c*, 10M, 10Y and 10K, respectively. The recording medium conveying belt 20 may be circulated by being supported by a plurality of support rollers 21, 22, 23 and 24. The recording medium conveying belt 20 may be substantially vertically provided, as illustrated in the view of FIG. 1. The four transfer rollers 40 are disposed to respectively face the photosensitive drums 11 of the developers 100, 10M, 10Y and 10K with the recording medium conveying belt 20 therebetween. A transfer bias is applied to the transfer rollers 40. The exposure units 30C, 30M, 30Y and 30K scan light corresponding to C, M, Y and B image information to the photosensitive drums 11 of the developers 10C, 10M, 10Y and 10K. A laser scanning unit ("LSU") that uses a laser diode as a light source may be used as each of the exposure units 30C, 30M, 30Y and 30K.

A process of forming a color image in the above configuration will now be explained.

The photosensitive drum 11 in each of the developers 10C, 10M, 10Y and 10K is charged with a uniform electric potential due to a charging bias applied to the charging roller 13. The four exposure units 30C, 30M, 30Y and 30K form electrostatic latent images by scanning light corresponding to C, M, Y and K image information to the photosensitive drums 11 of the developers 10C, 10M, 10Y and 10K. A developing bias is applied to the developing rollers 12. Toner attached to the outer circumferential surfaces of the developing rollers 12 is transferred to the electrostatic latent images, and C, M, Y and K toner images are respectively formed on the photosensitive drums 11 of the developers 10C, 10M, 10Y and 10K.

A medium to which the toner is to be finally applied, for example, the recording medium P, is drawn from a cassette 120 by a pickup roller 121. The recording medium P is introduced to the recording medium conveying belt 20 by feed rollers 122. The recording medium P is attached to a surface of the recording medium conveying belt 20 due to an electrostatic force, and is conveyed at the same speed as a linear speed of the recording medium conveying belt 20.

In one embodiment, for example, a front end of the recording medium P reaches a transfer nip at the same time as a front end of the C toner image formed on the outer circumferential surface of the photosensitive drum 11 of the developer 100 reaches the transfer nip facing the transfer roller 40. When a transfer bias is applied to the transfer roller 40, the C toner image formed on the photosensitive drum 11 is transferred to the recording medium P. As the recording medium P is conveyed, the M, Y and K toner images formed on the photosensitive drums 11 of the developers 10M, 10Y and 10K are sequentially transferred to the recording medium P to overlap one another, and thus a color toner image is formed on the recording medium P.

The color toner image formed on the recording medium P is maintained on a surface of the recording medium P due to an electrostatic force. The fusing device 300 fuses the color toner image onto the recording medium P by using heat and pressure. The recording medium P having been fused is discharged to the outside of the image forming apparatus by discharging rollers 123.

Figure 2:
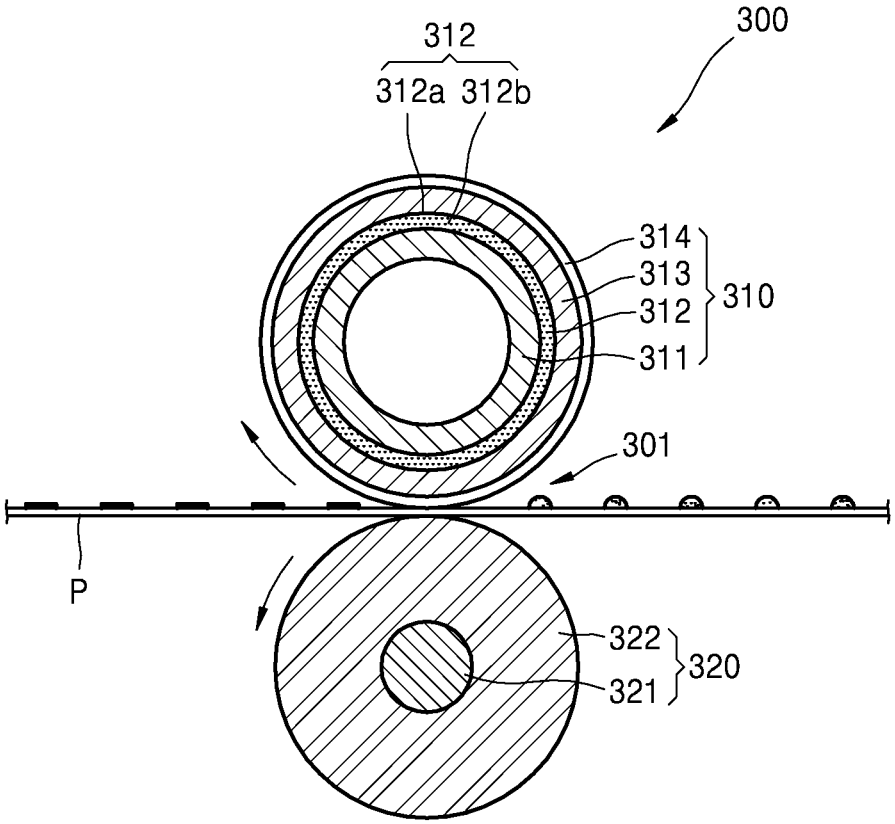
FIG. 2 is a cross-sectional view illustrating a fusing device embodied as a roller, according to an embodiment of the present invention.
Figure 3:
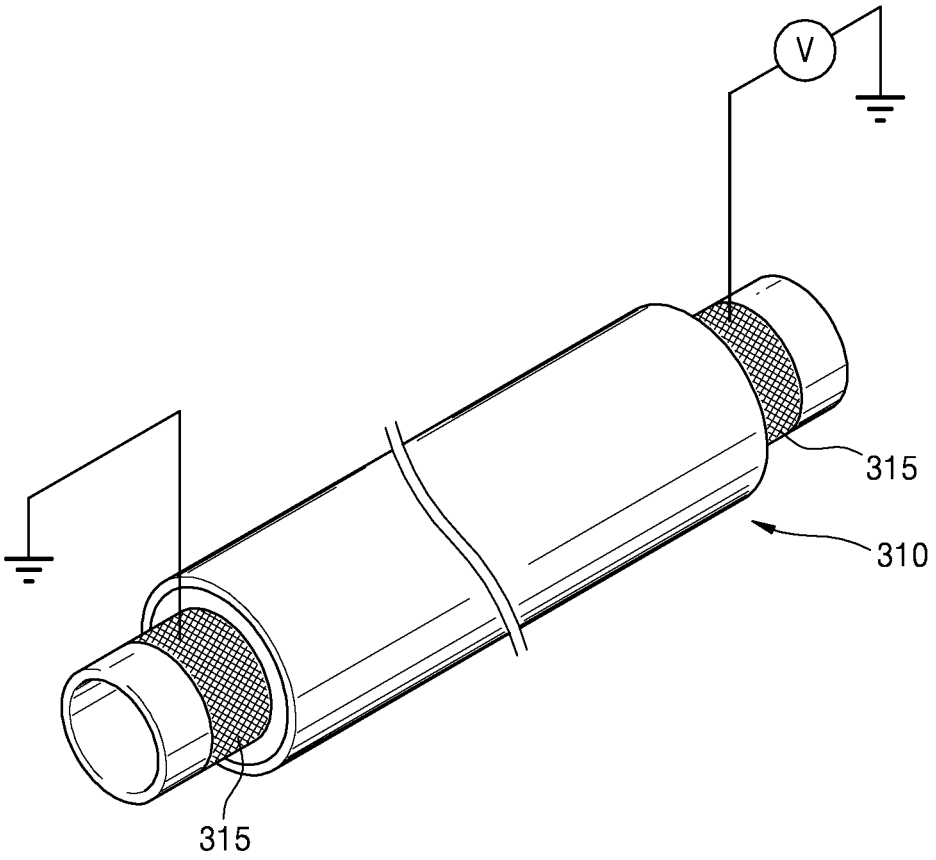
FIG. 3 is a perspective view illustrating a heating member applied to the fusing device of FIG. 2, according to an embodiment of the present invention.

FIG. 2 is a cross-sectional view illustrating the fusing device 300 according to an embodiment of the present invention. FIG. 3 is a perspective view illustrating the heating member 310 according to an embodiment of the present invention. The fusing device 300 of FIG. 2 is a roller-type fusing device including the heating member 310, which is embodied as a roller.

Referring to FIGS. 2 and 3, the heating member 310 and a pressure member 320, which are embodied as rollers, are illustrated. The pressure member 320 is a nip-forming unit that faces the heating member 310 and forms fusing nip 301 in cooperation with the heating member 310. In one embodiment, for example, the pressure member 320 is a roller in which an elastic layer 322 surrounds a metal core 321. The heating member 310 and the pressure member 320 are biased by a bias unit (not shown), for example, a spring, to be engaged with each other. As the elastic layer 322 of the pressure member 320 is partially deformed, the fusing nip 301 through which heat is transferred from the heating member 310 to the recording medium P, is formed.

The heating member 310 may include a resistive heating layer 312, a core 311 that supports the resistive heating layer 312, and a release layer 314. An intermediate layer 313 may be additionally disposed between the resistive heating layer 312 and the release layer 314, but the invention is not limited thereto. Electrodes 315 are respectively disposed on both of opposing end portions of the core 311. The electrodes 315 are connected to an external power supply source and supply current to the resistive heating layer 312 through the opposing end portions of the resistive heating layer 312.

The heating member 310 embodied as a roller includes the core 311 that has a hollow pipe shape. The roller-shaped heating member 310, which may be applied to the fusing device 300 of the electrophotographic image forming apparatus, is generally called a fusing roller.

Figure 4:
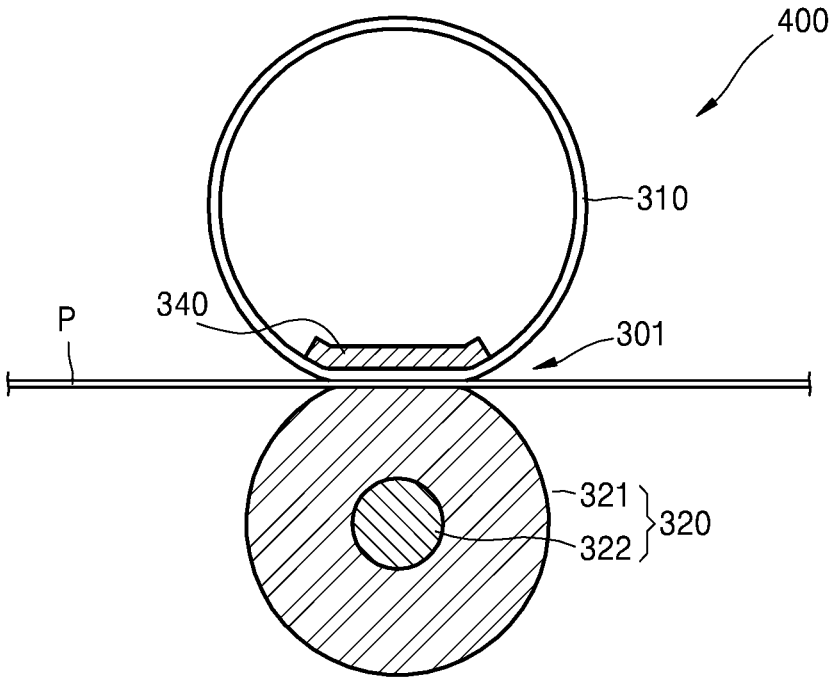
FIG. 4 is a cross-sectional view illustrating a fusing device embodied as a belt, according to another embodiment of the present invention.

FIG. 4 is a cross-sectional view illustrating a fusing device 300 according to another embodiment of the present invention. The fusing device 400 of FIG. 4 is different from the fusing device 300 of FIG. 2 in that the heating member 310 includes the core 311 that is embodied as a belt. The belt-shaped heating member 310 of FIG. 4, which may be applied to the fusing device 300 of FIG. 2, is generally called a fusing belt.

Referring to FIG. 4, the heating member 310, the pressure member 320 and a nip-forming member 340 are illustrated. The pressure member 320 and the nip-forming member 340 function as a nip-forming unit that forms the fusing nip 301. The nip-forming member 340 is disposed inside the closed-loop belt heating member 310. The pressure member 320 is disposed outside the heating member 310. In order to form the fusing nip 301, the nip-forming member 340 and the pressure member 320 are engaged with each other with the heating member 310 therebetween, and rotate. A bias unit (not shown) applies an elastic force to the nip-forming member 340 and/or the pressure member 320 such that the nip-forming member 340 and the pressure member 320 are engaged with each other to maintain the fusing nip 310.

Figure 5:
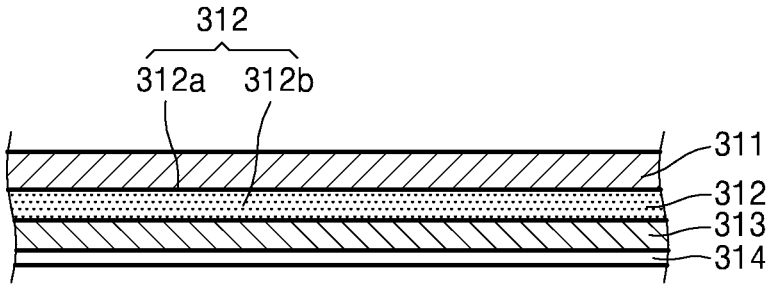
FIG. 5 is a cross-sectional view illustrating a heating member applied to the fusing device of FIG. 4, according to an embodiment of the present invention.

The heating member 310 may include the core 311, the resistive heating layer 312 that is disposed outside the core 311, and the release layer 314, as shown in FIG. 5. The intermediate layer 313 may be additionally disposed between the resistive heating layer 312 and the release layer 314. The electrodes 315 are disposed on both of opposing end portions of the core 311. The electrodes 315 are connected to an external power supply source, and supply current to the resistive heating layer 312 through the opposing end portions of the resistive heating layer 312.

In one embodiment, for example, the nip-forming member 340 may be pressed against the pressure member 320. Although not shown in FIG. 4, the nip-forming member 340, which is embodied as an elastic roller, may drive the heating member 310 while rotating along with the pressure member 320.

The heating member 310 will be explained in detail.

The core 311 may include, for example, a polymer-based material such as polyimide, polyimideamide or fluorine-based polymer, or a metal-based material. The fluorine-based polymer may include, but is not limited to, fluorinated polyetheretherketone ("PEEK"), polytetrafluoroethylene ("PTFE"), perfluoroalkoxy ("PFA"), and/or fluorinated ethylene propylene ("FEP"). The metal-based material may include, but is not limited to, stainless steel, nickel, copper and brass. When the core 311 includes a metal-based material having conductivity, an insulating layer (not shown) may be disposed between the core 311 and the resistive heating layer 312.

When the heating member 310 is embodied as a roller as shown in FIGS. 2 and 3, the core 311 may have a thickness whose strength is great enough to endure pressure for forming the fusing nips 301. When the heating member 310 is embodied as a belt as shown in FIGS. 4 and 5, the core 311 may have a thickness whose flexibility is great enough for the heating member 310 to be flexibly deformed from an original state while in the fusing nip 301 and to be restored to the original state when being separated or released from the fusing nips 301.

The resistive heating layer 312 may include a base polymer 312*a*, and an electrically conductive filler 312*b* that is dispersed in the base polymer 312*a*. A material of the base polymer 312*a* is not limited as long as the material has heat resistance that is great enough to endure a fusing temperature. In one embodiment, for example, the base polymer 312*a* may include a silicone-based polymer, and/or a high-heat resistance polymer such as polyimide, polyimideamide or a fluorine-based polymer. The fluorine-based polymer may include PTFE, PEEK, PFA and/or FEP. The resistive heating layer 312 may have elasticity. A hardness of the base polymer 312*a* may be adjusted according to a desired elasticity of the resistive heating layer 312. The base polymer 312*a* may include at least one of the above polymers. In one embodiment, for example, the base polymer 312*a* may be any one of the polymers, or a blend or a copolymer of two or more of the polymers.

One type of or two or more types of electrically conductive fillers 312*b* may be dispersed in the base polymer 312*a*. The electrically conductive filler 312*b* may include a metal-based filler such as metal particles, and/or a carbon-based filler. The carbon-based filler may include carbon nanotubes ("CNTs"), carbon black, carbon nanofiber, graphene, expanded graphite, graphite nano platelets and/or graphite oxide ("GO").

The electrically conductive filler 312*b* is dispersed in the base polymer 312*a* and forms an electrically conductive network. In one embodiment, for example, CNTs may be manufactured as a conductor or a resistor having a conductivity of about $10^{-4}$ Siemen per meter (S/m) to about 100 Siemens per meter (S/m) according to a content thereof. Since CNTs have a conductivity similar to that of a metal and have a very low density, a thermal capacity per unit volume (i.e., thermal capacity=density×specific heat) of CNTs is three to four times less than that of a general resistive material. Accordingly, the resistive heating layer 312 using CNTs as the electrically conductive filler 312*b* may very rapidly change temperature. Accordingly, when the heating member 310, including the resistive heating layer 312 including the electrically conductive filler 312*b*, is used, a time taken to change from a standby state to a printing state may be reduced to thereby permit fast first printing on the recording medium. Furthermore, since the heating member 310 does not need to be pre-heated in the standby state, power consumption may be reduced.

When a carbon-based filler, for example, CNTs, are used, a content of the CNTs may be appropriately determined between a minimum content that may form a meaningful conductive network and a maximum content that may not degrade mechanical properties of the resistive heating layer 312. In one embodiment, for example, a content of CNTs may be appropriately determined to range from about 1 wt % to about 50 wt %, or between about 1 part by weight to about 50 parts by weight based on 100 parts by weight of the resistance heating layer 112 including the CNT. In order to improve heat resistance of the resistive heating layer 312, the resistive heating layer 312 may include metal oxide particles such as $Fe_2O_3$ or $Al_2O_3$. A content of the metal oxide particles may be, for example, less than about 5 wt %, or about 5 parts by weight based on 100 parts by weight of the resistance heating layer 112.

The release layer 314 is the outermost layer of the heating member 310. An offset phenomenon in which toner on the recording medium P is melted and then is attached to the heating member 310 may undesirably occur during a fusing process. The offset phenomenon may lead to a defect in printing so that a part of an image on the recording medium P is not printed or jammed so that the recording medium P passing through the fusing nips 301 remains attached to a surface of the heating member 310 without being separated from the heating member 310. In order to reduce or effectively prevent toner from being attached to the heating member 310, the release layer 314 may be a polymer layer having good releasability. The release layer 314 may include, for example, a silicone-based polymer or a fluorine-based polymer. The fluorine-based polymer may include polyperfluoroether, fluorinated polyether, fluorinated polyimide, PEEK, fluorinated polyamide and/or fluorinated polyester. The release layer 314 may be one of the polymers, or a blend or a copolymer of two or more of the polymers.

The intermediate layer 313 may include, for example, an elastic layer. The intermediate layer 313 having elasticity may help the fusing nip 301 to have a sufficient size. When the intermediate layer 313 includes the same polymer as that of the release layer 314 and/or the resistive heating layer 312, an adhesive force between the intermediate layer 313 and the release layer 314 and/or the resistive heating layer 312 may be increased. Also, an amount of voltage withstood by the heating member 310 may be improved and the risk of an electric shock due to leakage current may be reduced.

Figure 7:
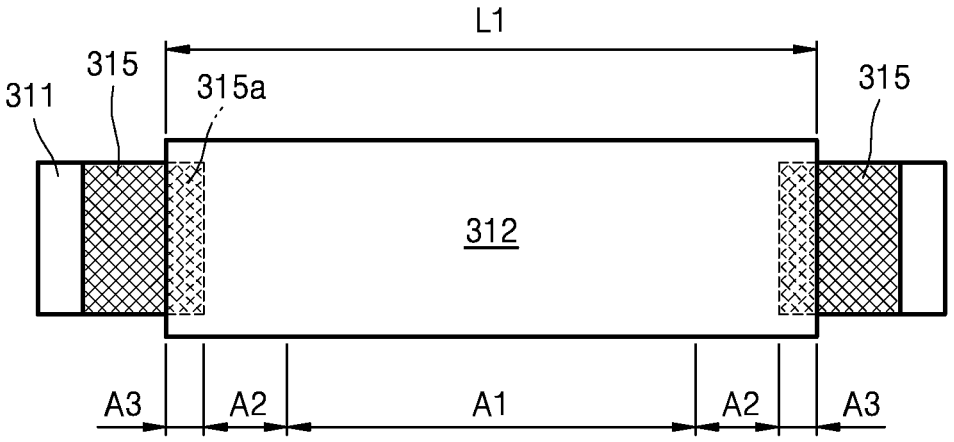
FIG. 7 is a cross-sectional view illustrating a sheet-passing area, a non-sheet-passing area and an electrode contact area of a resistive heating layer in a width direction of the resistive heating layer, according to an embodiment of the present invention.

The recording medium is elongated to have a length, and a width of the recording medium is taken perpendicular to the length thereof. A length of the heating member 310 may be determined to be greater than the width of the recording medium P on which an image may be fused. In detail, the length of the resistive heating layer 312 is greater than the width of the recording medium P, and a length of the core 311 is greater than the length of the resistive heating layer 312. An area of the heating member 310 through which the recording medium P passes is referred to as a sheet-passing area, and an area of the heating member 310 that is outside the sheet-passing area and through which the recording medium P does not pass is referred to as a non-sheet-passing area. In FIG. 7, a sheet-passing area and a non-sheet-passing area are illustrated. For convenience of explanation, the release layer 314 and the intermediate layer 313 are not shown and only the resistive heating layer 312 is shown in FIG. 7.

Figure 6:
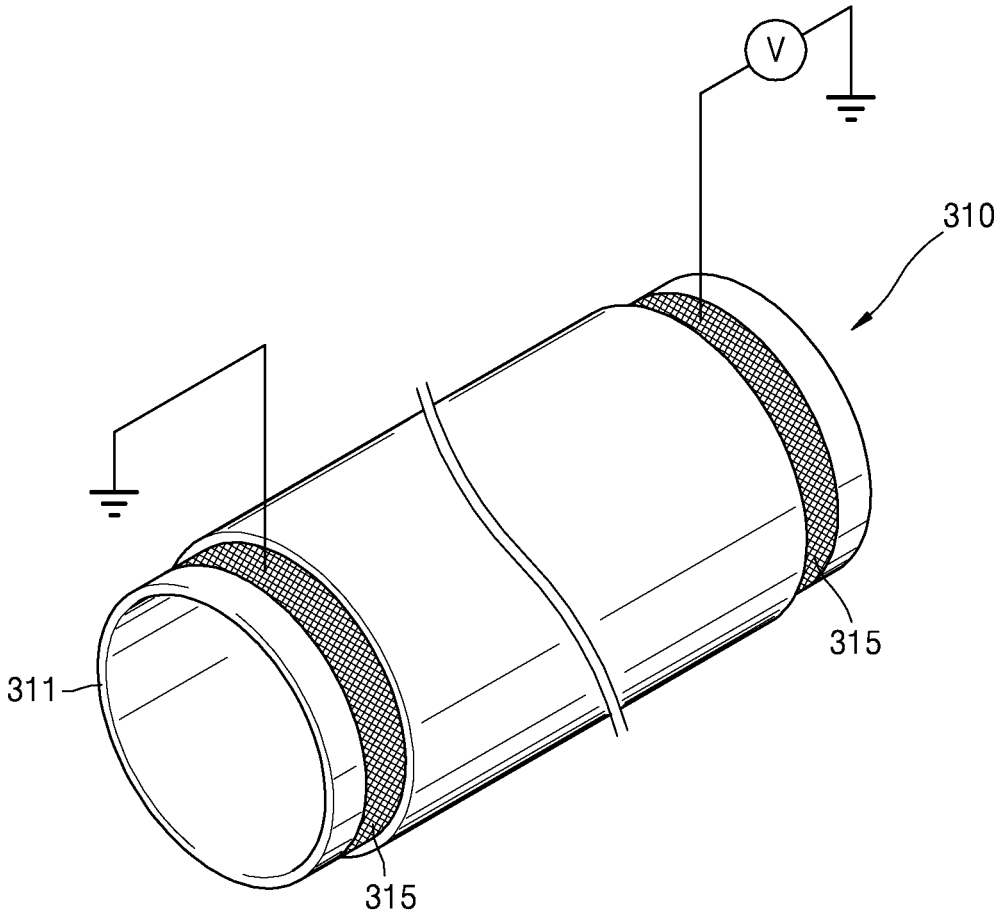
FIG. 6 is a perspective view illustrating the heating member applied to the fusing device of FIG. 4, according to an embodiment of the present invention.

Referring to FIG. 6 and FIG. 7, a length L1 of the resistive heating layer 312 in a width direction of the recording medium P may include lengths of a sheet-passing area A1 through which the recording medium P passes, a non-sheet-passing area A2 that is outside the sheet-passing area A1, and an electrode contact area A3 that is outside the non-sheet-passing area A2 and where the electrodes 315 and the resistive heating layer 312 contact each other. The recording medium P may not pass through the electrode contact area A3, as well as the non-sheet-passing area A2. The length of the sheet-passing area A1 may be equal to or slightly greater than a maximum width of the recording medium P which may pass through the fusing device 300.

Each of the electrodes 315 includes a contact portion 315*a* which contacts the resistive heating layer 312 in the electrode contact area A3. The contact portion 315*a* may fully or partially contact the electrode contact area A3 of the resistive heating layer 312. In order to effectively supply current to the resistive heating layer 312, the contact portion 315*a* may have, for example, a substantially cylindrical shape, so as to fully contact the resistive heating layer 312.

Since the recording medium P does not pass through the non-sheet-passing area A2 during a fusing process, heat generated in the resistive heating layer 312 is not transferred to the recording medium P. Hence, the non-sheet-passing area A2 may overheat to a fusing temperature or a higher temperature when the amount of heat generated in the resistive heating layer 312 is adjusted to maintain the sheet-passing area A1 at the fusing temperature. Once the non-sheet-passing area A2 is overheated, physical properties of the resistive heating layer 312, the intermediate layer 313 and/or the release layer 314 may be degraded, thereby degrading the durability of the heating member 310.

Figure 8:
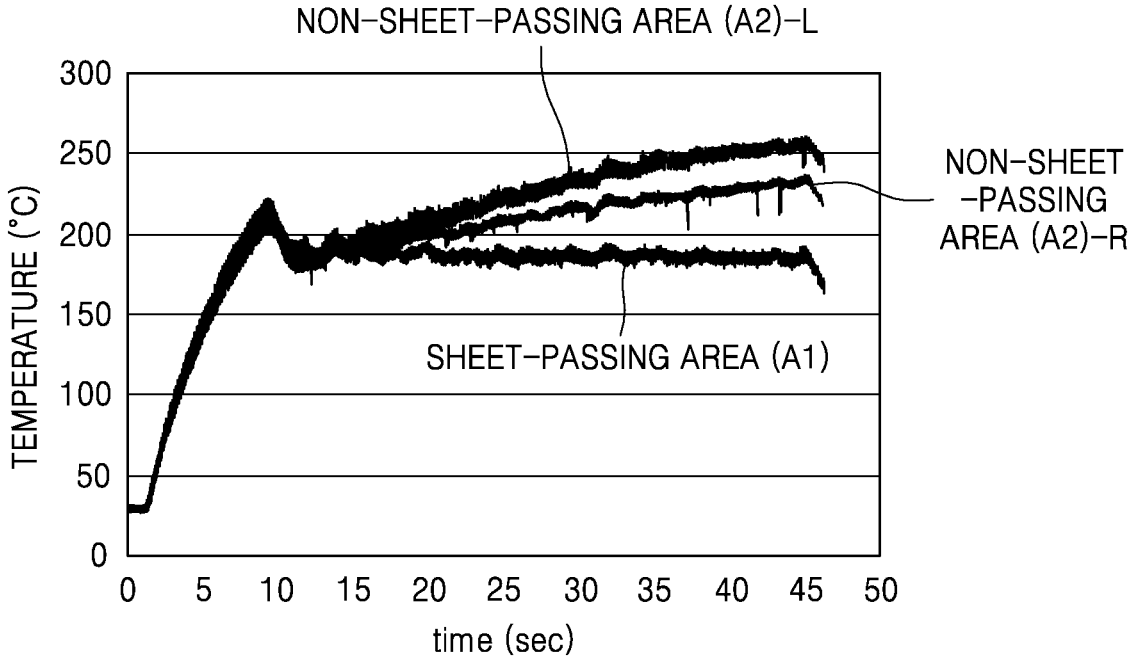
FIG. 8 is a graph illustrating temperature (Celsius: ° C.) as a function of time (seconds: sec) for a resistive heating layer, to indicate a non-sheet-passing area is overheated.

FIG. 8 is a graph illustrating temperature (Celsius: ° C.) as a function of time (seconds: sec) for a resistive heating layer, to indicate that the non-sheet-passing area A2 is overheated. Conditions of the heating member 310 during a test are as follows:

the core 311: polyimide, the resistive heating layer 312: silicone/CNTs, a content of the CNTs is about 16 wt %, the intermediate layer 313: silicone, the release layer 314: PFA, the heating member 310: belt, a length in a width direction of the recording medium is about 235 millimeters (mm), and the electrodes 315 without thermally conductive portion 315*b*: Ni, a length is about 15.5 mm.

Referring to FIG. 8, when a fusing temperature is set to be about 185° C., a temperature of the sheet-passing area A1 is maintained at about 185° C. during a fusing process, whereas temperatures of both non-sheet-passing areas A2-L and A2-R (at opposing ends of the core 311) through which the recording medium P does not pass exceed 185° C. and continuously increase to reach about 250° C. as the fusing process is performed.

Figure 9:
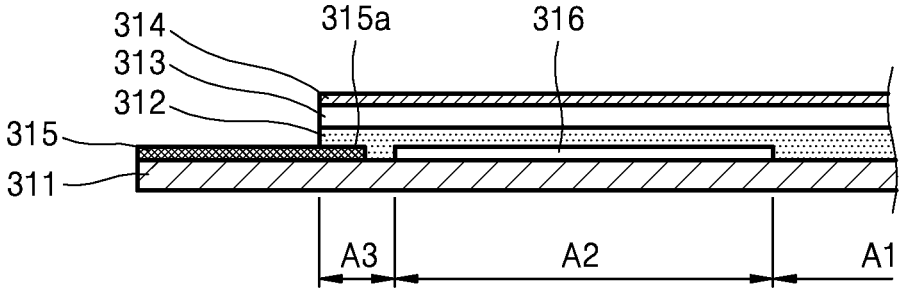
FIG. 9 is a partial cross-sectional view illustrating a heating member in which a thermally conductive layer and an electrode are separated from each other, according to an embodiment of the present invention.

In order to reduce or effectively prevent the non-sheet-passing area A2 from being overheated, a structure for dissipating heat of the non-sheet-passing area A2 may be considered. FIG. 9 is a cross-sectional view illustrating a heating member 310 including a structure for dissipating heat of the non-sheet-passing area A2. Referring to FIG. 9, a thermally conductive layer 316 is disposed in the non-sheet-passing area A2. The thermally conductive layer 316 is disposed between the core 311 and the resistive heating layer 312. The thermally conductive layer 316 may reduce or effectively prevent the non-sheet-passing area A2 from being overheated by removing heat generated in the non-sheet-passing area A2 of the resistive heating layer 312. The electrodes 315 and the thermally conductive layer 316 are in and/or on a same layer of the heating member 310.

Figure 10:
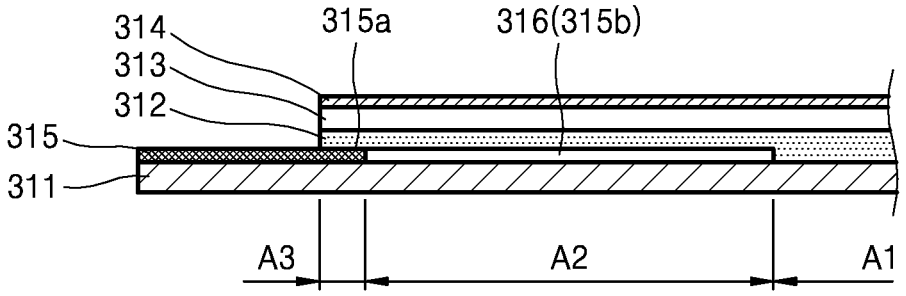
FIG. 10 is a partial cross-sectional view illustrating a heating member in which a thermally conductive layer and an electrode are connected to each other, according to another embodiment of the present invention.

Although each of the electrodes 315 and the thermally conductive layer 316 are spaced apart from each other in FIG. 9, the present invention is not limited thereto. As shown in FIG. 10, each of the electrodes 315 and the thermally conductive layer 316 may be connected to (e.g., contacting) each other. Where the electrodes 315 and the thermally conductive layer 316 are connected to each other, heat generated in the non-sheet-passing area A2 of the resistive heating layer 312 may be more effectively removed by the thermally conductive layer 316 in cooperation with each of the electrodes 315. In FIG. 10, each of the electrodes 315 extends to a boundary of the non-sheet-passing area A2. That is, the electrodes 315 may be defined as including a contact portion 315*a* of which an entire portion thereof contacts the resistive heating layer 312 in the electrode contact area A3, and a thermally conductive portion 315*b* that extends from the contact portion 315*a* into the non-sheet-passing area A2 and of which less than an entire portion thereof contacts the resistive heating layer 312. That is, the contact portion 315 of the electrode 315 and the thermally conductive heating layer 316 may effectively form an electrode member.

Although each of the electrodes 315 and the thermally conductive layer 316 have the same cross-sectional thickness in FIGS. 9 and 10, the present invention is not limited thereto. The thermally conductive layer 316 may have a cross-sectional thickness less than or greater than a cross-sectional thickness of each of the electrodes 315 in order to effectively dissipate heat of the non-sheet-passing area A2 of the resistive heating layer 312 and maintain a temperature of the non-sheet-passing area A2 at an appropriate level.

In an embodiment of manufacturing a heating member, before the resistive heating layer 312 is formed (e.g., provided), the electrodes 315 and the thermally conductive layer 316 may be formed by applying a metal layer on a surface of the core 311 by using a process such as sputtering, deposition, coating, application or plating.

Each of the electrodes 315 and the thermally conductive layer 316 may be sequentially formed as described above and may be connected to each other, but the invention is not limited thereto. Where the electrodes 315 and the thermally conductive layer 316 are sequentially formed and connected to each other, a large contact resistance may be respectively generated between each of the electrodes 315 and the thermally conductive layer 316. When the electrodes 315 and the thermally conductive layer 316 include different materials, or when the electrodes 315 and the thermally conductive layer 316 include the same material but are individually formed, a contact resistance may be increased.

In order to minimize a contact resistance between each of the electrodes 315 and the thermally conductive layer 316, the electrodes 315 and the thermally conductive layer 316 may include the same material by using a single process in the manufacturing of the heating member. Examples of the single process may include sputtering, deposition, coating, application and plating as described above. From among these processes, plating may be used in order to simplify an overall manufacturing process of the heating member and reduce manufacturing costs. When the core 311 includes a conductive material, electrolytic plating may be used. However, when the heating member 310 is embodied as a belt, the core 311 may include a non-conductive material. Even when the core 311 includes a conductive material, since an insulating layer (not shown) is generally disposed between the resistive heating layer 312 and the core 311, a surface on which the electrodes 315 and the thermally conductive layer 316 are formed is often a non-conductive surface. Hence, electroless plating may be used as the single process for forming the electrodes 315 and the thermally conductive layer 316. Examples of a plating material may include nickel (Ni), copper (Cu), palladium (Pd), silver (Ag), and gold (Au). Phosphorus (P) or boron (B) may be added into the plating material.

Electroless plating may be applied to any surface which is subsequently subjected to surface treatment, and may easily form a desired shape by using an appropriate masking process. However, when the heating member 310 is embodied as a belt, the core 311 may be very thin. In one embodiment, for example, when a relatively thick plating layer is formed on the core 311 which has low rigidity and has deformability such as a polyimide tube, the core 311 may be deformed. In order to minimize deformation of the core 311 during a manufacturing process of a heating member, a columnar plating film, which vertically grows on a surface during plating, may be used, to uniformly apply a force in all directions while the columnar plating film is grown. Assuming that Ni is plated on a polyimide tube to a cross-sectional thickness of about 40 micrometers (μm), it is found through experiments that when layer-type plating is performed, the polyimide tube is deformed, whereas when columnar plating is performed to the same cross-sectional thickness, a plating film is vertically grown on a surface and the polyimide tube maintains the original shape thereof even after the plating film is formed.

In one embodiment, the heating member 310 in which each of the electrodes 315 and the thermally conductive layer 316 are spaced apart from each other, as shown in FIG. 9, may be manufactured by forming a mask having a predetermined distance between each of the electrodes 315 and the thermally conductive layer 316 and performing electroless plating. Also, when the electrodes 315 and the thermally conductive layer 316 have different cross-sectional thicknesses, the electrodes 315 and the thermally conductive layer 316 may be formed to predetermined cross-sectional thicknesses, a mask may be formed on each of the electrodes 315 or the thermally conductive layer 316, and plating may be additionally performed.

Figure 11:
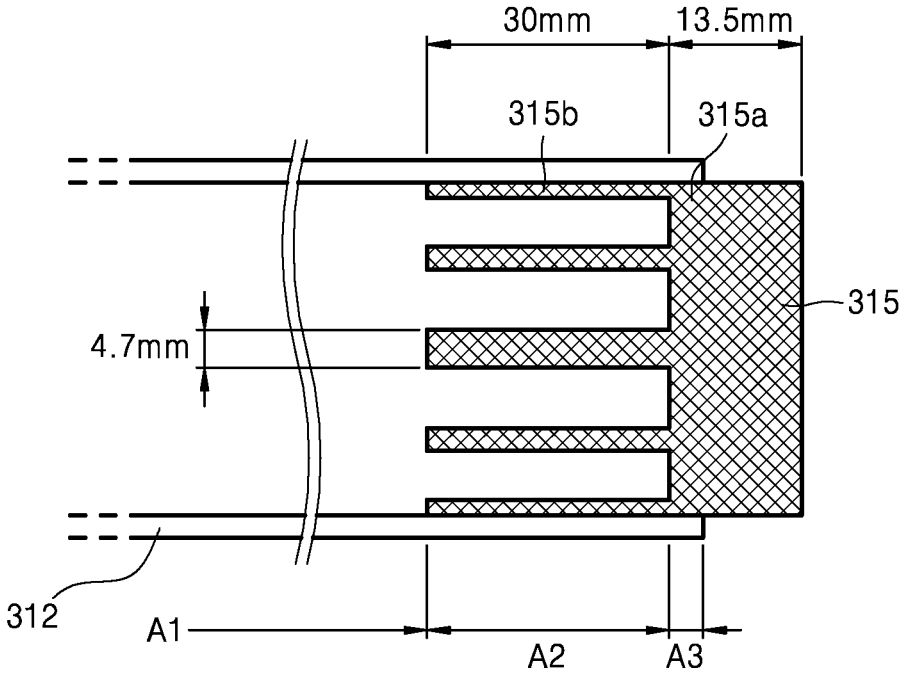
FIG. 11 is a cross-sectional view illustrating a heating member including a thermally conductive layer connected to an electrode, according to another embodiment of the present invention.

FIG. 11 is a cross-sectional view illustrating a heating member including a thermally conductive layer, according to another embodiment of the present invention. Conditions of the heating member 310 are as follows:

the core 311: polyimide, the resistive heating layer 312: silicone/CNTs, a content of the CNTs is about 16 wt %, the intermediate layer 313: silicone, the release layer 314: PFA, the heating member 310: belt, a length in a width direction of the recording medium is about 235 mm, the electrodes 315: Ni, a length excluding the thermally conductive portion 315*b* is about 13.5 mm, the thermally conductive layer 316: Ni, 8 thermal conductors around the core 11, each having a size of 4.7 mm (width)× 30 mm (length), and a manufacturing process: the electrodes 315 and the thermally conductive layer 316 are formed by using a single process such as electroless nickel plating, and intervals between adjacent thermal conductors are the same.

The contact electrode 315 may be a single, unitary, indivisible member, as including the contact portion 315*a* and the thermally conductive portion 315*b*, but the invention is not limited thereto or thereby. A plurality of protrusions extended from the contact portion 315*a* may collectively form the thermally conductive portion 316.

Figure 12:
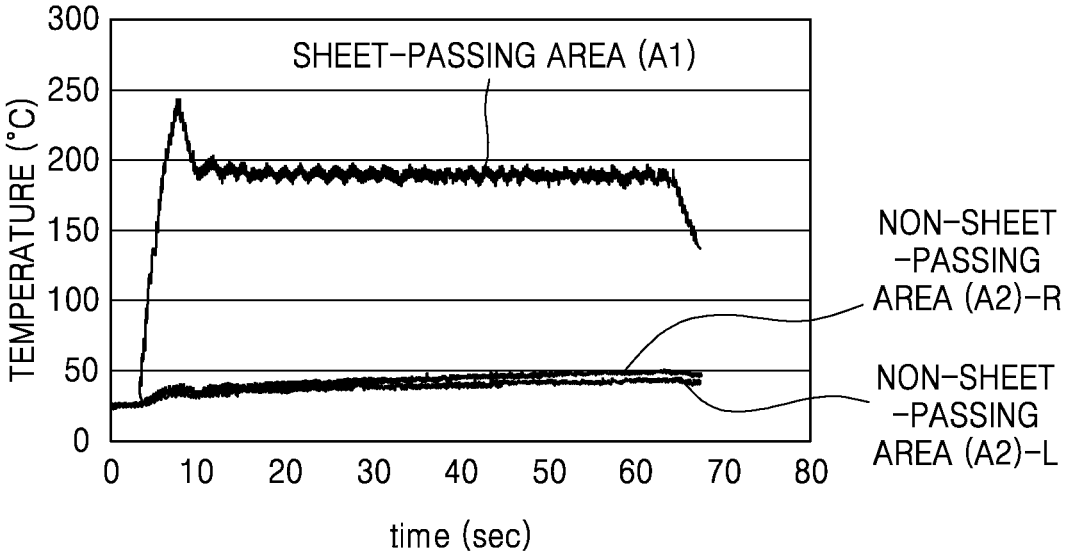
FIG. 12 is a graph illustrating temperatures (° C.) of the sheet-passing area and the non-sheet-passing area with respect to time (sec) if a fusing process in the fusing device when the heating member of FIG. 11 is used.

FIG. 12 is a graph illustrating temperatures (° C.) of the sheet-passing area A1 and the non-sheet-passing area A2 of the resistive heating layer 112 during a fusing process when the heating member 310 of FIG. 11 is used. Referring to FIG. 12, when a fusing temperature is set to be about 185° C., a temperature of the sheet-passing area A1 is maintained at about 185° C. during the fusing process, whereas temperatures of the non-sheet-passing areas A2-L and A2-R reach about 50° C. after about 1 minute elapses and thus overheating of the non-sheet-passing area A2 of the resistive heating layer is reduced or effectively prevented.

Figure 13:
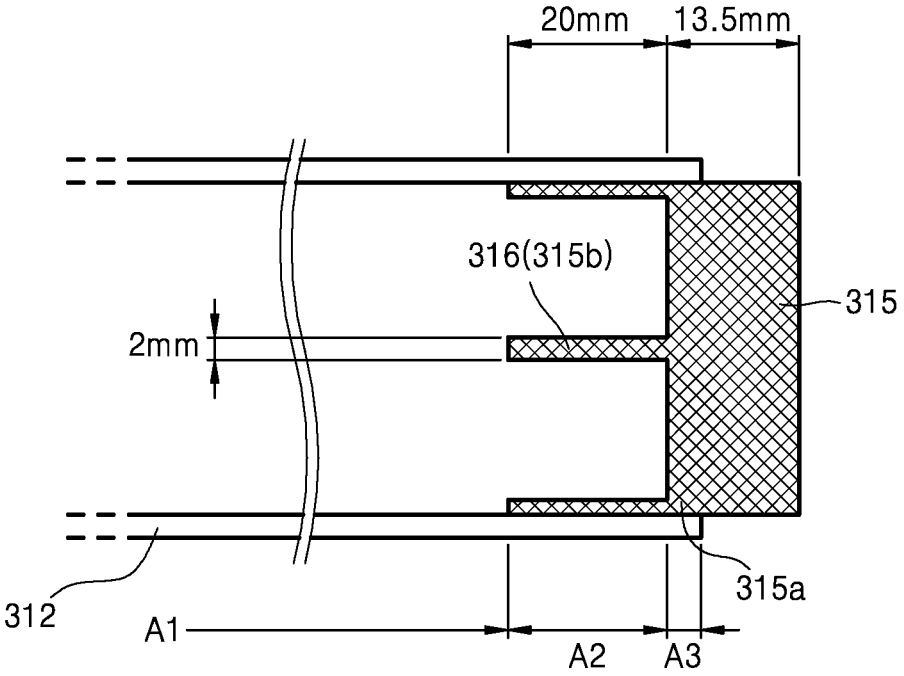
FIG. 13 is a cross-sectional view illustrating a heating member including a thermally conductive layer connected to an electrode, according to still another embodiment of the present invention.

FIG. 13 is a cross-sectional view illustrating a heating member including a thermally conductive layer, according to still another embodiment of the present invention. Conditions of the heating member 310 are as follows:

the core 311: polyimide, the resistive heating layer 312: silicone/CNTs, a content of the CNTs is about 16 wt %, the intermediate layer 313: silicone, the release layer 314: PFA, the heating member 310: belt, a length in a width direction of the recording medium is about 235 mm, the electrodes 315: Ni, a length excluding the thermally conductive portion 315*b*(316) is about 13.5 mm, the thermally conductive layer 316: Ni, 4 thermal conductors around the core 311, each having a size of 2 mm×20 mm, and a manufacturing process: the electrodes 315 and the thermally conductive layer 316 are formed by using a single process such as electroless nickel plating, intervals between adjacent thermal conductors are the same.

Figure 14:
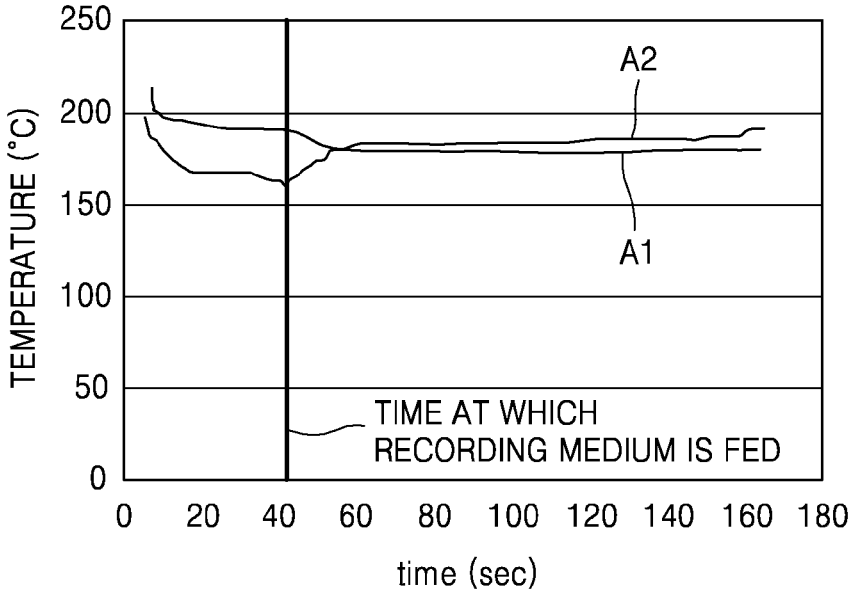
FIG. 14 is a graph illustrating temperatures (° C.) of the sheet-passing area and the non-sheet-passing area for a resistive heating layer with respect to time (sec) of a fusing process in the fusing device when the heating member of FIG. 13 is used.

FIG. 14 is a graph illustrating temperatures (° C.) of the sheet-passing area A1 and the non-sheet-passing area A2 of the resistive heating layer during a fusing process when the heating member 310 of FIG. 13 is used. Referring to FIG. 14, when a fusing temperature is set to be about 185° C., a temperature of the sheet-passing area A1 is maintained at about 185° C. during the fusing process, whereas a temperature of the non-sheet-passing area A2 is higher by about 10° C. than that of the sheet-passing area A1, but the non-sheet-passing area A2 is not overheated. Also, a heating temperature of the non-sheet-passing area A2 at a time when the recording medium P is not fed is lower by about 20° C. than that of the sheet-passing area A1.

Figure 15:
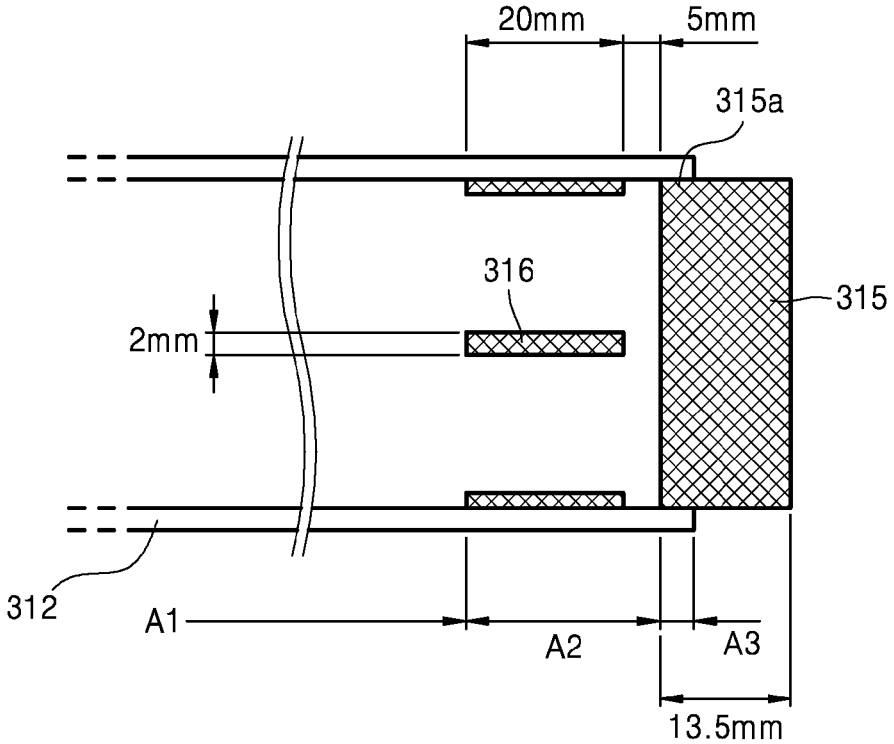
FIG. 15 is a cross-sectional view illustrating a heating member in which a thermally conductive layer is separated from an electrode, according to yet another embodiment of the present invention.

FIG. 15 is a cross-sectional view illustrating a heating member in which a thermally conductive layer and each electrode are separated from each other, according to yet another embodiment of the present invention. Conditions of the heating member 310 are as follows:

the core 311: polyimide, the resistive heating layer 312: silicone/CNTs, a content of the CNTs is about 16 wt %, the intermediate layer 313: silicone, the release layer 314: PFA, the heating member 310: belt, a length in a width direction of the recording medium is about 235 mm, the electrodes 315: Ni, a length excluding the thermally conductive portion 315*b* is about 13.5 mm, the thermally conductive layer 316: Ni, 4 thermal conductors around the core 311, each having a size of 2 mm×20 mm, an interval between adjacent electrodes 315 and the thermally conductive layer 316: 5 mm, and a manufacturing process: the electrodes 315 and the thermally conductive layer 316 are formed by using a single process such as electroless nickel plating, intervals between the 4 thermal conductors are the same.

Figure 16:
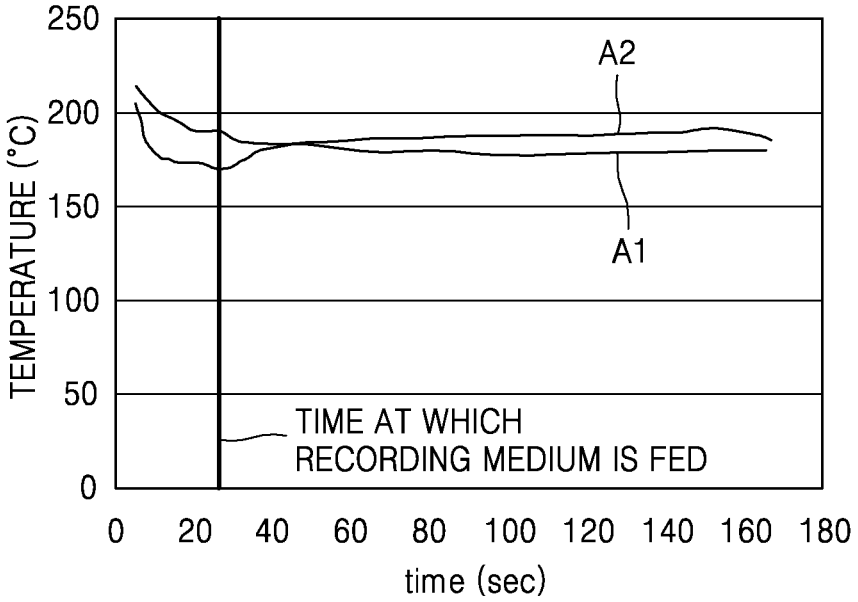
FIG. 16 is a graph illustrating temperatures (° C.) of the sheet-passing area and the non-pas area for a resistive heating layer with respect to time (sec) of a fusing process in the fusing device when the heating member of FIG. 15 is used.

FIG. 16 is a graph illustrating temperatures (° C.) of the sheet-passing area A1 and the non-sheet-passing area A2 of the resistive heating layer during a fusing process when the heating member 310 of FIG. 15 is used. Referring to FIG. 16, when a fusing temperature is set to be about 185° C., a temperature of the sheet-passing area A1 is maintained at about 185° C. during the fusing process, whereas a temperature of the non-sheet-passing area A2 is higher by about 10° C. than that of the sheet-passing area A1 but the non-sheet-passing area A2 is not overheated. Also, a heating temperature of the non-sheet-passing area A2 at a time when paper is not fed is lower by about 20° C. than that of the sheet-passing area A1.

Figure 17:
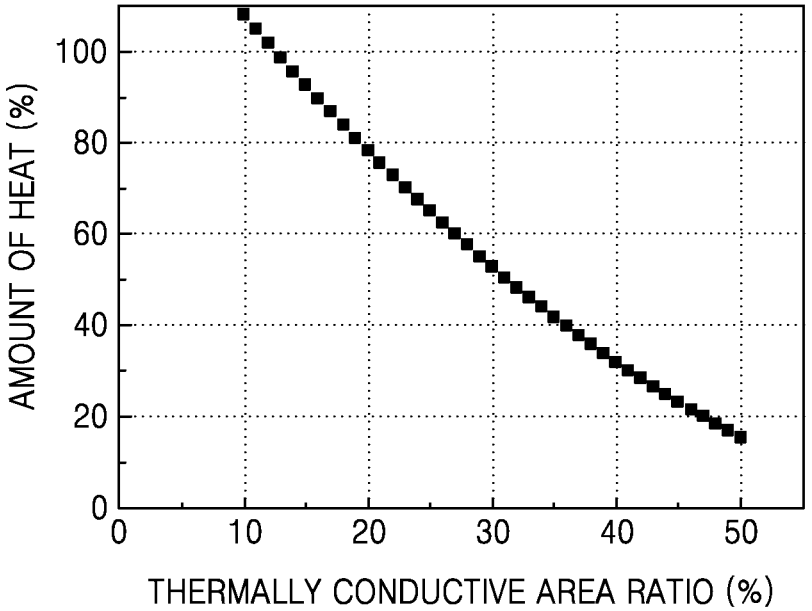
FIG. 17 is a graph illustrating a relationship between a ratio (percent: %) of an area of the thermally conductive layer to an area of the non-sheet-passing area and the amount of heat (%) generated in the non-sheet-passing area.

FIG. 17 is a graph illustrating a relationship between a ratio (percent: %) of a planar area of the thermally conductive layer 316 to a planar area of the non-sheet-passing area A2 in which the thermally conductive layer 316 is disposed (thermally conductive area ratio) and an amount (%) of heat generated in the non-sheet-passing area A2. In FIG. 17, the amount of heat generated in the non-sheet-passing area A2 when a temperature of the non-sheet-passing area A2 is maintained at a control temperature of the sheet-passing area A1, that is, a fusing temperature is 100% in the vertical axis.

When a temperature of the non-sheet-passing area A2 is too low, a temperature of the sheet-passing area A1 may be affected, thereby degrading fusing quality. It is found through experiments that when a ratio of an area of the thermally conductive layer 316 to an area of the non-sheet-passing area A2 ranges from about 5% to about 25%, overheating of the non-sheet-passing area A2 may be reduced or effectively prevented and appropriate fusing quality may be ensured. In one embodiment, for example, when a ratio of an area of the thermally conductive layer 316 to an area of the non-sheet-passing area A2 is about 12%, a temperature of the non-sheet-passing area A2 may be maintained at a control temperature (a fusing temperature). Also, in order to reduce or effectively prevent a temperature of the non-sheet-passing area A2 from being excessively reduced in consideration of a fusing speed, the amount of heat generated in the non-sheet-passing area A2 may be about 80%. Where the amount of heat generated in the non-sheet-passing area A2 may be about 80%, a ratio of an area of the thermally conductive layer 316 to an area of the non-sheet-passing area A2 is about 20%. Accordingly, a ratio of an area of the thermally conductive layer 316 to an area of the non-sheet-passing area A2 may range from about 12% to about 20%.

Figure 18:
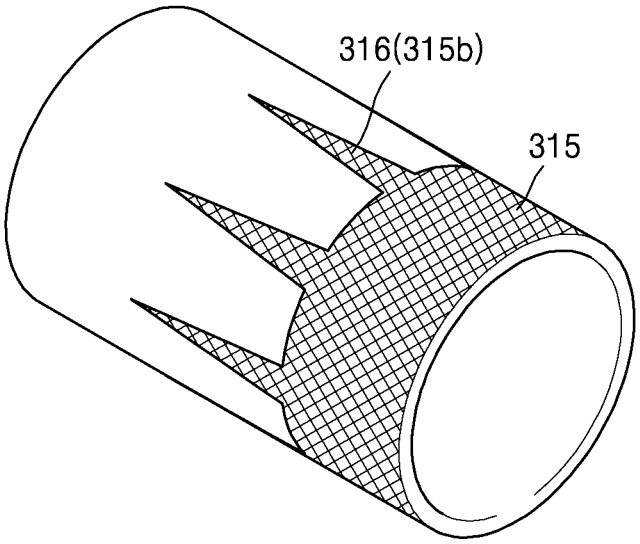
FIGS. 18 and 19 are perspective views illustrating the thermally conductive layers according to embodiments of the present invention.
Figure 19:
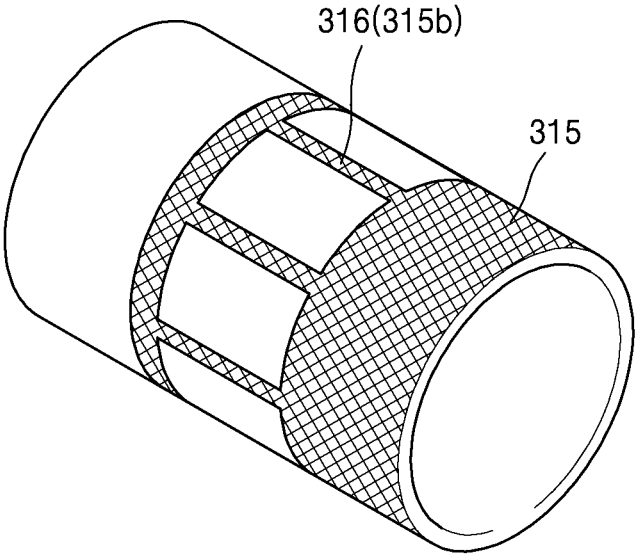

A planar shape of the thermally conductive layer 316 is not limited to those in FIGS. 11, 13 and 15. A shape of the thermally conductive layer 316 is not limited as long as a ratio of a planar area of the thermally conductive layer 316 to a planar area of the non-sheet-passing area A2 ranges from about 5% to about 25%. In alternative embodiments, for example, as shown in FIG. 18 or 19, a plurality of triangular thermal conductors may be arranged extending from the contact portion 315*a* or a plurality of quadrangular thermal conductors may be arranged extending from the contact portion 315*a* and connected to one another by a further conductive member (unnumbered) extending in a circumferential direction of the heating member 310.

In one or more embodiment of the present invention, a heating member has been applied to a fusing device of an electrophotographic image forming apparatus. However, a device to which a heating member may be applied is not limited to a fusing device, and the heating member may be applied to any of various devices that require a heating source for generating heat by using electricity.

While the present invention has been particularly shown and described with reference to embodiments thereof, these embodiments are provided for the purposes of illustration and it is understood by those of ordinary skill in the art that various modifications and equivalent other embodiments can be made from the present invention. Accordingly, the true technical scope of the present invention is defined by the technical spirit of the appended claims.

What is claimed is:

1. A heating member comprising:

a resistive heating layer comprising:

a medium-passing area, and non-medium-passing areas respectively on opposing sides of the medium-passing area at opposing side portions of the resistive heating layer;

a core which supports the resistive heating layer;

a thermally conductive layer between the resistive heating layer and the core, and disposed in a non-medium passing area at a side portion of the resistive heating layer; and an electrode which is between the resistive heating layer and the core, contacts the side portion of the resistive heating layer and supplies current to the resistive heating layer, wherein a ratio of a contact area between the thermally conductive layer and the resistive heating layer to an area of the non-medium-passing area in which the thermally conductive layer is disposed, ranges from about 5% to about 25%.

2. The heating member of claim 1, wherein the ratio of the contact area between the thermally conductive layer and the resistive heating layer to the area of the non-medium-passing area in which the thermally conductive layer is disposed, ranges from about 12% to about 20%.

3. The heating member of claim 1, wherein the electrode is connected to the thermally conductive layer.

4. The heating member of claim 1, wherein the electrode is separated from the thermally conductive layer.

5. The heating member of claim 1, wherein the electrode and the thermally conductive layer comprise a same material.

6. The heating member of claim 1, wherein the electrode and the thermally conductive layer are electroless plated.

7. The heating member of claim 6, wherein the electrode and the thermally conductive layer has a columnar structure.

8. The heating member of claim 7, wherein the electrode and the thermally conductive layer comprise a material selected from the group consisting of nickel (Ni), copper (Cu), palladium (Pd), silver (Ag) and gold (Au), and a combination thereof.

9. The heating member of claim 7, wherein the electrode and the thermally conductive layer comprise one of phosphorus (P) and boron (B).

10. A heating member comprising:

a resistive heating layer comprising:

a medium-passing area, non-medium-passing areas respectively on opposing sides of the medium-passing area at opposing side portions of the resistive heating layer, and electrode contact areas respectively at the opposing side portions of the resistive heating layer, and opposing the medium-passing area with respect to the non-medium-passing areas;

a core which supports the resistive heating layer; and an electrode which is between the core and the resistive heating layer, supplies current to the resistive heating layer, and respectively contacts a side portion of the resistive heating layer, wherein the electrode comprises:

a contact portion which contacts an electrode contact area at the side portion of the resistive heating layer, and a thermally conductive portion which extends from the contact portion, is between the core and the resistive heating layer, and contacts a non-medium-passing area at the side portion of the resistive heating layer.

11. The heating member of claim 10, wherein a ratio of a contact area between the thermally conductive portion and the resistive heating layer to an area of the non-medium-passing area of the resistive heating layer, ranges from about 5% to about 25%.

12. The heating member of claim 11, wherein the ratio of the contact area between the thermally conductive portion and the resistive heating layer to the area of the non-medium-passing area of the resistive heating layer, ranges from about 12% to about 20%.

13. The heating member of claim 12, wherein the electrode comprises metal and is electroless plated.

14. The heating member of claim 13, wherein the electrode has a columnar structure.

15. A fusing device comprising:

the heating member of claim 1; and a nip-forming unit which faces the heating member and forms a fusing nip in cooperation with the heating member.

16. The fusing device of claim 15, wherein the ratio of the contact area between the thermally conductive layer and the resistive heating layer to the area of the non-medium-passing area in which the thermally conductive layer is disposed, ranges from about 12% to about 20%.

17. The fusing device of claim 15, wherein the electrode and the thermally conductive layer are connected to each other.

18. The fusing device of claim 15, wherein the electrode and the thermally conductive layer are separated from each other.

19. The fusing device of claim 15, wherein the electrode and the thermally conductive layer comprise a same material.

20. The fusing device of claim 15, wherein the electrode and the thermally conductive layer are electroless plated, and wherein the electrode and the thermally conductive layer has a columnar structure.

* * * * *